US007159747B1

(12) United States Patent
Tanner

(10) Patent No.: US 7,159,747 B1
(45) Date of Patent: Jan. 9, 2007

(54) METHOD AND APPARATUS FOR INSTALLING A CARPETING TACK STRIP

(76) Inventor: Preston A. Tanner, P.O. Box 1953, Andrews, TX (US) 79714

( * ) Notice: Subject to any disclaimer, the term of this patent is extended or adjusted under 35 U.S.C. 154(b) by 0 days.

(21) Appl. No.: 10/712,838

(22) Filed: Nov. 13, 2003

(51) Int. Cl.
*B25C 5/11* (2006.01)

(52) U.S. Cl. ..... 227/139; 227/147

(58) Field of Classification Search ..... 227/134, 227/139, 140, 147, 129, 148; 173/121, 211
See application file for complete search history.

(56) References Cited

U.S. PATENT DOCUMENTS

| | | | | | |
|---|---|---|---|---|---|
| 220,933 | A | | 10/1879 | McGill | |
| 329,278 | A | * | 10/1885 | Copeland | 227/147 |
| 1,412,507 | A | | 4/1922 | Carter | |
| 2,557,000 | A | * | 6/1951 | Holmes | 29/244 |
| 2,643,379 | A | * | 6/1953 | Matovich | 227/147 |
| 2,783,799 | A | | 3/1957 | Hart | |
| 2,845,103 | A | | 7/1958 | Sypher | |
| 3,060,440 | A | * | 10/1962 | DeCaro et al. | 227/147 |
| 3,060,441 | A | * | 10/1962 | Henning | 227/147 |
| 3,066,302 | A | * | 12/1962 | DeCaro et al. | 227/10 |
| 3,711,008 | A | * | 1/1973 | Clifford et al. | 227/147 |
| 4,030,654 | A | * | 6/1977 | York | 227/110 |
| 4,062,483 | A | * | 12/1977 | Brigante | 227/147 |
| 4,065,045 | A | * | 12/1977 | Pray | 227/147 |
| 4,120,438 | A | * | 10/1978 | Litch | 227/147 |
| 4,204,625 | A | | 5/1980 | Glenn | |
| 4,403,725 | A | * | 9/1983 | Lawrence | 227/147 |
| 4,461,418 | A | * | 7/1984 | Schaefer | 227/147 |
| 4,483,475 | A | * | 11/1984 | Whitaker | 227/147 |
| 5,529,234 | A | * | 6/1996 | Juneau | 227/147 |
| 5,642,568 | A | | 7/1997 | Lapka | |
| 5,875,950 | A | * | 3/1999 | Nuss et al. | 227/113 |
| 5,875,951 | A | * | 3/1999 | Ingle et al. | 227/147 |
| 6,318,620 | B1 | * | 11/2001 | Anstett et al. | 227/147 |

* cited by examiner

*Primary Examiner*—Stephen F. Gerrity
*Assistant Examiner*—Paul Durand
(74) *Attorney, Agent, or Firm*—Wyatt, Tarrant & Combs, LLP

(57) ABSTRACT

The present invention is directed to an apparatus for use in installing tack strips (e.g., as in carpet installation). This apparatus includes a body that has a longitudinal reference axis, first and second longitudinally spaced ends, and a longitudinally oriented body aperture that extends along the reference axis and between the first and second ends of the body. Further, a striker pin that is movable along the reference axis is disposed within at least a portion of the body aperture. Still further, at or toward the first end of the body of the apparatus is a tack strip track assembly that has a tack strip-accommodating guide channel defined therein. Moreover, this track assembly generally includes a substantially immobile spacer for promoting appropriate spacing of a tack strip from a surface.

7 Claims, 2 Drawing Sheets

METHOD AND APPARATUS FOR INSTALLING A CARPETING TACK STRIP

CROSS-REFERENCE TO RELATED APPLICATION

None.

STATEMENT REGARDING RESEARCH/DEVELOPMENT FUNDING

None.

BACKGROUND OF THE INVENTION

1. Field of the Invention

The present invention generally relates to carpeting tack strips and, more particularly, to an apparatus for attaching such a tack strip to a support structure (e.g., a wood or concrete floor).

2. General Background of the Invention

In the installation of carpet (e.g., wall to wall), side portions (or peripheral edges) of the carpet are typically anchored to a floor or other appropriate support structure upon which they are installed by employing what is known in the art as a "tack strip". A tack strip is generally an elongated length of material (e.g., wood or metal) that may be placed along the edge portion of a floor and then anchored to the floor by means of nails or other appropriate fasteners. After these tack strips have been anchored to the floor, the carpet is generally held in place by a plurality of brads associated with the tack strip to thereby hold the carpet, prevent its removal, and/or prevent the danger of an individual catching a foot on the edge of the carpet when walking across it.

These tack strips are typically installed adjacent walls or wall finishing elements. It is generally accepted that the distance that carpet is installed from the walls and thus the location of the tack strip must be properly dimensioned and marked. However, precise uniform spacing of these strips from and along walls and wall finishing elements can be difficult using conventional installation tools. For instance, some conventional tack strip nailers are equipped with adjustable spacing assemblies so that the same tool may be used regardless of the desired distance of the resultantly installed tack strip. However, due to the amount of shock/vibration associated with operating tack strip nailers, these adjustable spacers tend to undesirably move resulting in spacing variations of the installed tack strips relative to a wall from which they are to be spaced.

Another detriment associated with conventional tack strip nailers tend to have a significant number of exposed metal edges (e.g., sharp corners). Accordingly, use of the same has traditionally coincided with marring of adjacent walls and wall finishing surfaces during tack strip installation. Yet another detriment of these typical tack strip nailers is that they are made up of a significant number of movable parts that are both expensive to manufacture and expensive to assemble into the resultant tack strip nailer.

SUMMARY OF THE INVENTION

Accordingly, it is an object of the present invention to provide a tack strip nailer apparatus that enhances a user's ability to install tack strips at a substantially uniform distance from a desired surface (e.g., wall or base boards). Another object of the present invention is to provide a tack strip nailer apparatus that at least generally reduces the propensity for marring the surface(s) from which the tack strip is to be spaced. Still another object is to provide a tack strip nailer apparatus that is cost-efficient to manufacture and/or that has a reduced number of movable parts (relative to conventional tack strip nailers). Yet another object is to provide a tack strip nailer apparatus that light weight and/or easy to use (relative to conventional tack strip nailers). These objectives, as well as others, may be met by the tack strip nailer apparatus of the present invention described herein.

A first aspect of the present invention is embodied in a tack strip installing apparatus that includes a body, a striker pin, and a tack strip track assembly. The body of this apparatus has a longitudinal reference axis, first and second longitudinally spaced ends, and a longitudinally oriented body aperture that extends along the reference axis and between the first and second ends of the body. This body aperture includes a fastener-accommodating first portion disposed toward the first end of the body. In one characterization, this configuration of the body at least generally enables the apparatus to be placed atop (or in association with) a tack strip so that a started fastener (e.g., a nail) of the tack strip may be received into the fastener-accommodating first portion of the body aperture.

The striker pin associated with the first aspect of the present invention includes a shaft, a part of which is generally disposed within at least a second portion of the body aperture, and a strikable impact head interconnected with the shaft and disposed beyond the body aperture. This striker pin of the apparatus may be said to be at least generally movable both along the reference axis and relative to the body.

Still with regard to the first aspect, the tack strip track assembly of the apparatus is disposed toward the first end of the body, and defines a tack strip accommodating guide channel therein. This track assembly includes a spacer disposed on a first side of the guide channel. This spacer is characterized as being substantially immobile relative to the body of the apparatus. Preferably, the spacer includes at least one substantially planar surface that is oriented substantially parallel to the reference axis and that is interfacable with a surface (e.g., wall or base board) from which the tack strip accommodating guide channel is to be spaced.

Various refinements exists of the features noted in relation to the subject first aspect of the present invention. Further features may also be incorporated in the subject first aspect of the present invention as well. These refinements and additional features may exist individually or in any combination. For instance, the striker pin may be said to be disposable in at least first and second positions, so that the striker pin is disposed in the fastener-accommodating portion of the body aperture in only one of the first and second positions. For example, the striker pin, in what may be characterized as a "resting" position, may not be found within the fastener-accommodating first portion of the body aperture. However, upon actuation (e.g., impacting the striker pin with a hammer or the like), the striker pin may reach an "actuated" position of sorts, where the striker pin is forced into the fastener-accommodating first portion of the body aperture (e.g., to drive a started fastener disposed therein into the tack strip and the support structure thereunder).

The shaft of the striker pin associated with the first aspect of the invention may be characterized as having a shaft length measured along the reference axis of the body. This shaft length is preferably longer than a body length of the body measured along the reference axis from the first end to the second end of the body. In one embodiment, the shaft of the striker pin may be said to have a substantially uniform cross-sectional dimension perpendicular to the reference axis of the body. While this cross-sectional dimension may be any of a number of appropriate shapes/dimensions, the cross-sectional dimension of the striker pin is preferably circular.

The apparatus of the first aspect may include what may be characterized as a rubber body extension of sorts. This rubber body extension is preferably interconnected with the second end of the body, and preferably includes a longitudinally oriented extension aperture that extend along the reference axis in substantial alignment with the body aperture. One benefit of having this rubber body extension is that it provides a shock-absorbing or vibration dampening feature for the apparatus. Another benefit of having this rubber body extension, at least in one embodiment, is that it provides a pin retaining feature for the apparatus. That is, a frictional interface between the striker pin and a sidewall that defines the extension aperture of the rubber body extension at least generally reduces the tendency of the nail striker dissociating from a remainder of the apparatus.

With regard to embodiments of this first aspect that include the above-described rubber body extension, a washer may be connected with the rubber body extension. This washer is preferably disposed at an end of the rubber body extension that is generally most remote (e.g., farthest away) from the second end of the body. While this washer may be connected with the rubber body extension in any of a number of appropriate manners, it is preferably at least partially embedded (e.g., at least partially enclosed) in the rubber body extension. Further, some embodiments that include a washer also include a spring that is disposed about the shaft of the striker pin between the washer and the impact head of the striker pin. This arrangement may be said to at least generally enable the spring to interface with the washer and impact head of the striker pin to recoil (e.g., return) the striker pin to a "resting" position after being impacted into an "actuated" position as described above.

Still with regard to embodiments that include the above-described rubber body extension, the spacer may be characterized as having a first lateral extent of a first magnitude in a first direction substantially perpendicular to the reference axis of the body. In other words, if the apparatus is positioned in an appropriate manner on a floor, the spacer would "stick out" toward the wall a first distance. Further, the rubber body extension of such an embodiment may be said to have a second lateral extent of a second magnitude in the first direction. That is, when the apparatus is positioned on the floor, the rubber body extension would "stick out" toward the wall a second distance. Preferably, the first distance associated with the spacer is greater than the second distance associated with the rubber body extension. This arrangement may be said to provide a benefit of reducing an incidence of marring walls by having the spacer project out further than, preferably, a remainder of the apparatus. Moreover, the use of rubber (or other appropriate protective and/or padding material) in the composition of the body extension beneficially reduces the incidence of wall marring upon any contact of the body extension with the wall.

In the case of the first aspect, the apparatus may include a handle that is interconnected with and that extends out from the body between the first and second ends of the body. Preferably, this handle is substantially immobile relative to the body. In one embodiment, a shock absorbing material (e.g., rubber or the like) may be disposed about at least a portion of the handle (and/or the body).

A second aspect of the present invention is also directed to an apparatus for use in installing a tack strip. The apparatus of this second aspect includes a spacer for spacing a tack strip a substantially uniform distance from a surface (e.g., wall or base board). In addition to this spacer, the apparatus includes a substantially cylindrical aperture for accommodating at least a portion of a started first fastener associated with the tack strip. This aperture associated with the second aspect has an effective aperture diameter of no more than about twice an effective fastener diameter of the first fastener. That is, a diameter of the widest part (e.g., head) of the fastener is no less than half of the diameter of the aperture of the apparatus. Moreover, the apparatus includes a striker pin that is at least partially disposable in the aperture, and that is for driving at least a portion of the started first fastener through the tack strip and into a support structure (e.g., floor). A benefit of this second aspect is that the configuration of the aperture relative to the started fastener enhances an alignment of the striker pin and the started fastener to promote a sufficient impact of the striker pin against the started fastener, thus promoting adequate installation of the tack strip.

Yet a third aspect of the present invention is also embodied in an apparatus for use in installing a tack strip. The apparatus of this third aspect includes a body, a striker pin, a body extension, a washer, and a spring. The body of this apparatus has a longitudinal reference axis, first and second longitudinally spaced ends, and a longitudinally oriented body aperture that extends along the reference axis and between the first and second ends of the body. The striker pin is both movable along the reference axis and relative to the body. Moreover, this striker pin includes a shaft disposable within at least a portion of the body aperture, and a strikable impact head interconnected with the shaft and disposed beyond the body aperture. The body extension of this third aspect is distinct from the body, and is interconnected with the second end of the body. This body extension includes a longitudinally oriented extension aperture that extends along the reference axis in substantial alignment with the body aperture. Further, the washer is connected with the body extension and is disposed at an end of the body extension that is most remote (e.g., farthest away) from the second end of the body. Moreover, this washer includes a washer aperture through which the reference axis extends. The spring is disposed about the shaft of the striker pin between the washer and the impact head of the striker pin.

Generally, each of the various features discussed herein in relation to one or more of the described aspects of the present invention may be utilized by any other aspect(s) of the present invention as well, alone or in any combination.

DETAILED DESCRIPTION OF THE DRAWINGS

Figure 1:
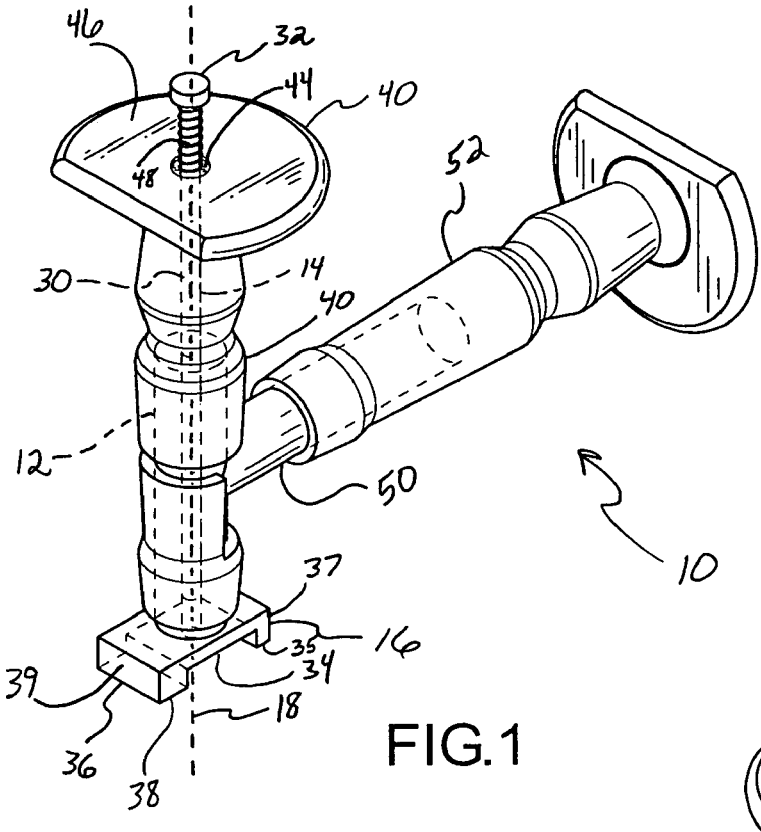
FIGS. 1–2 are perspective views of an apparatus for installing a tack strip.
Figure 2:
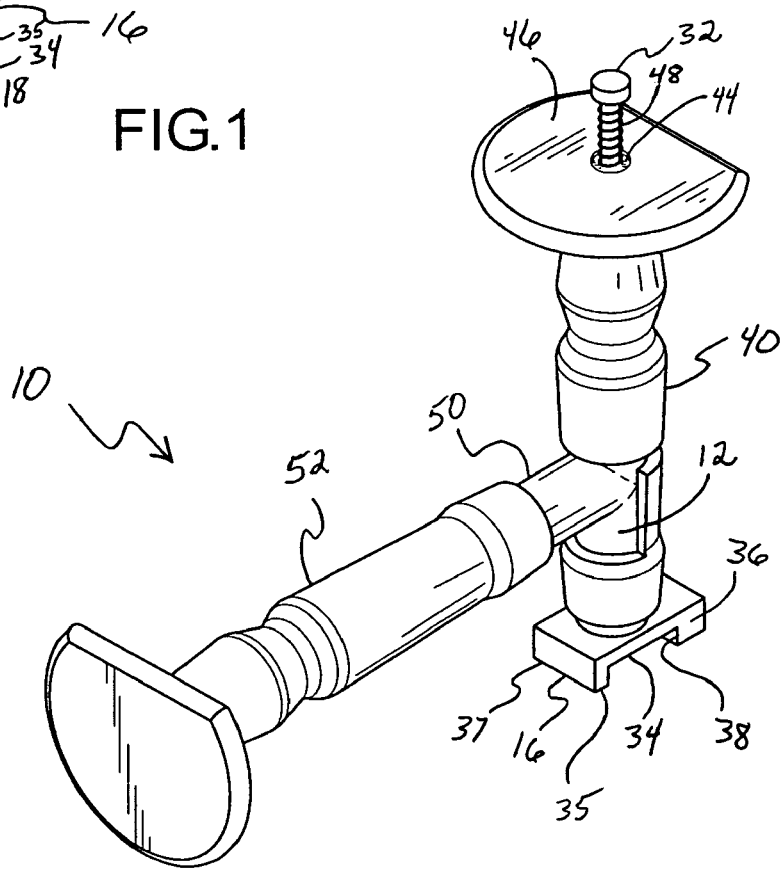

The present invention will now be described in relation to the accompanying drawings, which at least assist in illustrating the various pertinent features thereof. FIGS. 1–4 show a tack strip installing apparatus 10 that includes a body 12 that is shown as having a longitudinal reference axis 18, first and second longitudinally spaced ends 20, 22 (respectively), and a longitudinally oriented body aperture 24 that extends at least generally along the reference axis 18 between the first and second ends 20, 22 of the body 12. This body aperture 24 may be characterized as having a fastener-accommodating first portion 26 disposed toward the first end 20 of the body 12 and a second portion 28 disposed at least generally between the first portion 26 and the second end 22 of the body 12.

A striker pin 14 of the apparatus 10 shown in FIGS. 1–4 includes a shaft 30 that is at least partially disposed within the second portion 28 of the body aperture 24, and an impact head 32 interconnected with the shaft 30. As illustrated, this impact head 32 is preferably designed to reside outside the body aperture 24. So, in one exemplary characterization, it may be said that the impact head 32 is at least generally too big to fit into the body aperture 24. However, other embodiments of the apparatus 10 may have a striker pin 14 that is equipped with an impact head 32 that may at least potentially fit into the body aperture 24. In any event, this striker pin 14 of the apparatus 10 is movable along the reference axis 18 relative to the body 12 of the apparatus 10.

Figure 3:
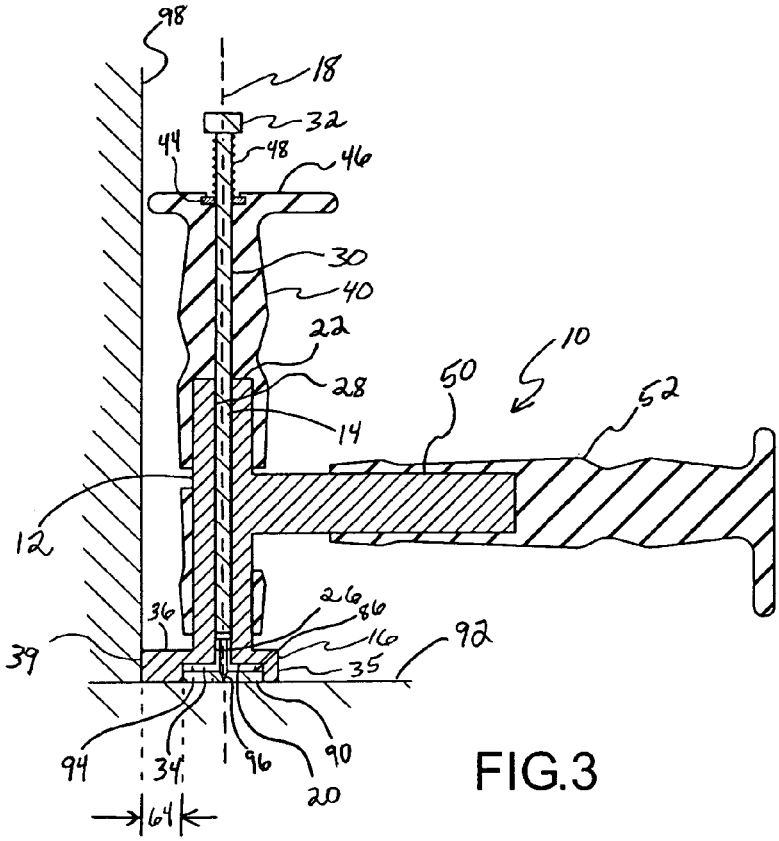
FIG. 3 is a cross-sectional side view of the apparatus of FIGS. 1–2 and a tack strip having a started fastener.
Figure 4:
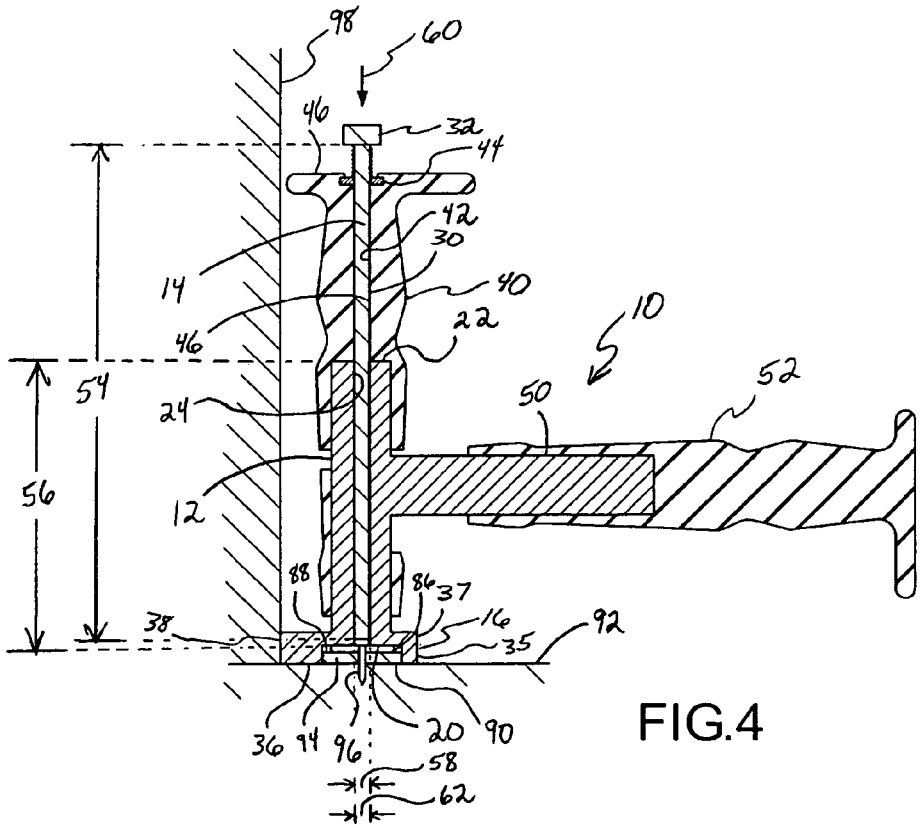
FIG. 4 is a cross-sectional side view of the apparatus of FIG. 3 with the fastener of the tack strip being driven through the tack strip and into a support structure.

FIGS. 3–4 illustrate that the striker pin 14 is at least generally disposable in what may be characterized as first and second positions relative to the body 12 of the apparatus 10. More particularly, FIG. 3 illustrates the striker pin 14 in the first position or what may be referred to as a "resting position." In this first position, the striker pin 14 is not disposed within the fastener-accommodating first portion 26 of the body aperture 24. However, upon actuation (e.g., impacting the striker pin 14 with a hammer or the like), the striker pin 14 moves along the reference axis 18 at least generally in the direction indicated by arrow 60 (FIG. 4) to reach the second or "actuated" position. This actuated position shown in FIG. 4 is at least generally characterized by the striker pin 14 being forced into the fastener-accommodating first portion 26 of the body aperture 24 to drive a started fastener 96 disposed therein into an associated tack strip 94 and a support structure 92 that is disposed under the tack strip 94.

Referring to FIG. 4, the shaft 30 of the striker pin 14 has a shaft length 54 measured along the reference axis 18 of the body 12. This shaft length 54 may be characterized as being longer than a body length 56 of the body 12 measured along the reference axis 18 from the first end 20 to the second end 22 of the body 12. While the shaft 30 of the striker pin 14 may exhibit a number of appropriate configurations, it is preferred that the shaft 30 have a substantially uniform cross-sectional dimension (measured perpendicular to the reference axis 18). Moreover, while this cross-sectional dimension may be any of a number of appropriate shapes/dimensions, it is also preferred that the cross-sectional dimension of the striker pin 14 be substantially circular.

Whatever the configuration of the shaft 30 of the striker pin 14, the body aperture 24 is preferably configured to complimentarily accommodate the striker pin 14. That is, a cross-sectional design of the body aperture 24 is preferably complimentary to a cross-sectional design of the shaft 30 of the striker pin 14. Moreover, the body aperture 24 and the shaft 30 of the striker pin 14 are preferably designed so that a sufficient amount of clearance between the two exists to enable movement of the striker pin 14 along the reference axis 18 relative to the body 12. Further, this clearance is preferably not enough to allow a significant amount of movement of the striker pin 14 relative to the body 12 in a direction that is not substantially parallel to the reference axis 18.

Accordingly, since the preferred cross-sectional dimension of the shaft 30 of the striker pin 14 is of a substantially circular arrangement, the preferred cross-sectional dimension of the body aperture 24 is of a substantially cylindrical arrangement. This is also beneficial in that the first portion 26 of the body aperture 24 is generally configured to accommodate at least a portion of the started fastener 96 (FIGS. 3–4), which is preferably round. With regard to its relationship to the started fastener 96, this body aperture 24 preferably has an effective aperture diameter 58 of no more than about twice an effective fastener diameter 62 of the fastener 96. In other words, the diameter 62 of the widest part (e.g., head) of the fastener 96 is no less than half of the diameter 58 of the body aperture 24 of the apparatus 10. In FIG. 4, the effective fastener diameter 62 is slightly less than the effective aperture diameter 58. Again, this enhances an alignment of the striker pin 14 and the started fastener 96 to promote a sufficient impact of the striker pin 14 against the started fastener 96, thus promoting adequate attachment of the tack strip 94 to the support structure 92.

A tack strip track assembly 16 of the apparatus 10 is found at the first end 20 of the body 12. This track assembly 16 is at least generally configured to accommodate a tack strip (e.g., 94) therein. A tack strip-accommodating guide channel 34 is defined in the track assembly 16. This track assembly 16 includes a spacer 36 that is disposed on a first side 38 of the guide channel 34 and a guide rail 35 disposed on a second side 37 of the guide channel 34 opposite the first side 38. The spacer 36 associated with the track assembly 16 is shown as being integral with (and thus substantially immobile relative to) the body 12 of the apparatus 10. Moreover, this spacer 36 includes a substantially planar surface 39 that is oriented substantially parallel to the reference axis 18. The substantially planar surface 39 of the spacer 36 generally enables the spacer 36 of at least one embodiment of the apparatus 10 to be interfacable with a surface (e.g., wall) 98 in a substantially flush relationship. It should be noted that other embodiments of the apparatus 10, may include spacers 36 that have a substantially planar surface 39 which is not substantially parallel with the reference axis 18, or spacers 36 that may be devoid of a substantially planar surface (e.g., have a rounded or arcuate surface). Accordingly, any surface that still enables a tack strip to be spaced from a surface may be incorporated with the spacer 36.

Interconnected with the body 12 at or toward the second end 22 of the same is a body extension 40. This body extension 40 defines a longitudinally oriented extension aperture 42 therein that extends along the reference axis 18 in substantial alignment with the body aperture 24. This extension aperture 42 may or may not exhibit an aperture diameter that is substantially equal to that of the body aperture 24. While this body extension 40 may be interconnected with the body 12 in any of a number of appropriate manners, it is preferably held on (at least in part) via a frictional interface with the body 12. Moreover, the body extension 40 is preferably made of rubber (e.g., blown rubber) or the like. However, the body extension 40 may be made of any of a number of other appropriate materials. Preferably, these other appropriate materials are at least generally capable of providing one of more of the following benefits: 1) shock-absorbing/vibration dampening; and 2) striker pin retainment (e.g., a frictional interface between the striker pin 14 and a sidewall 46 that defines the extension aperture 42 of the body extension 40, which at least generally reduces the tendency of the striker pin 14 dissociating from a remainder of the apparatus 10).

A washer 44 is connected with the body extension 40 of the apparatus 10. More particularly, this washer 44 is disposed at an end 46 of the body extension 40 that is generally most remote (e.g., farthest away) from the second end 22 of the body 12. While this washer 44 may be interconnected with the body extension 40 in any of a number of appropriate manners, it is preferably at least partially embedded (e.g., at least partially enclosed) in the body extension 40. Further, a spring 48 is disposed about the shaft 30 of the striker pin 14 at least generally between the washer 44 and the impact head 32 of the striker pin 14. This arrangement at least generally enables the spring 48 to interface with the washer 44 and impact head 32 of the striker pin 14 to recoil (e.g., return) the striker pin 14 to a "resting" position (shown in FIG. 3) after being impacted into an "actuated" position (shown in FIG. 4), which will be described in more detail below.

Interconnected with the body 12 of the apparatus 10 is a handle 50 that is that extends out from the body 12 between the first and second ends 20, 22 of the body 12. More particularly, this handle 50 is shown as extending out from the body 12 at a substantially perpendicular orientation relative to the reference axis 18. While this handle 50 is shown as being substantially integral with the body 12 of the apparatus 10, other embodiments include handles 50 that are attached to the body 12 in any of a number of appropriate manners (e.g., welding, adhesive, mechanical fasteners). Further, while this handle 50 is preferably immobile relative to the body 12 of the apparatus 10, other embodiments may include a handle 50 that may be adjustable (e.g., angled at a variety of orientations relative to the body 12).

The handle 50 of the apparatus 10 is equipped with handle cover 52 that is disposed about at least a portion of the same. While this handle cover 52 may be composed a number of appropriate materials, it is preferably constructed from a shock absorbing material such as blown rubber, for example. While not illustrated, some embodiments of the apparatus 10 may include a handle 50 and/or a handle cover 52 that includes a balancing foot of sorts that is remotely disposed from where the handle 50 interconnects with the body 12. This optional balancing foot may at least generally assist a user in maintaining the user's balance and/or the orientation of the apparatus 10 during use.

The apparatus 10 shown in FIGS. 1–4 may be used in a variety of appropriate manners. The following description of a protocol for using the apparatus 10 is an example of one such appropriate manner.

Referring to FIG. 3, a first side 90 of the tack strip 94 is generally disposed in contact with the support structure 92. This enables a second side 88 of the tack strip 94 (found opposite the first side 90) that has a plurality of angled brads 86 and the started fastener 96 associated therewith to "face up." Herein, reference to the fastener 96 as being "started" refers to the fastener 96 having a first end that encroaches at least the second side 88 of the tack strip 94, and a second end (e.g., head end) that is opposite the first end and that is spaced from the second side 88 of the tack strip 94 as generally shown in FIG. 3.

Once the tack strip 94 is disposed on the support structure 92 in an appropriate manner, the apparatus 10 is positioned so that at least the second end (e.g., head end) of the fastener 96 is disposed at least generally within the first portion 26 of the body aperture 24 of the body 12 of the apparatus 10. This at least generally results in a beneficial longitudinal alignment of the striker pin 14 and the fastener 96 along the reference axis 18.

This positioning of the body 12 relative to the fastener 96 is preferably accompanied by the tack strip 94 being positioned at least generally between the spacer 36 and the guide rail 35 of the track assembly 16, which may be characterized as a "straddling" of the tack strip 94 by the track assembly 16 of the apparatus 10. Moreover, the apparatus 10 is preferably oriented so that both the spacer 36 and the guide rail 35 of the track assembly 16 are in contact with the support structure 92.

After the apparatus 10 is positioned so that the track assembly 16 straddles the tack strip 94, the apparatus 10 may be moved in a direction that is substantially parallel to the surface of the support structure 92 to move the tack strip 94 at least generally toward or away from the surface 98 from which it is to be spaced. By abutting the spacer 36 of the apparatus 10 against the surface 98, the user can at least generally promote proper spacing of the tack strip 94 from the surface 98 by a distance substantially equal to a width 64 (FIG. 3) of the spacer 36.

With regard to positioning the apparatus 10 and the tack strip 94 relative to the surface 98, it should be noted that the width 64 of the spacer 36 may be any desired width, but is preferably between about 0.125 inch and about 0.750 inch, and is more preferably about 0.250 inch. With the desired width 64 of the spacer 36 in mind, a remainder of the apparatus 10 is preferably designed so that only the spacer 36 comes into contact with the surface 98. In other words, the apparatus 10 is preferably designed so that only the spacer 36 is in contact with the surface 98 when both the spacer 36 and the guide rail 35 are in contact with the support structure 92. This arrangement may at least generally reduce an incidence of marring the surface 98.

Once the apparatus 10 and the tack strip 94 are positioned appropriately relative to each other and the surface 98 (as described above), the impact head 32 of the striker pin 14 is impacted (e.g., by striking with a hammer or the like), which causes the striker pin 14 to move along the reference axis 18 in the direction 60 (FIG. 4). This impact of the striker pin 14 cause the striker pin 14 to strike the second end (e.g., head end) of the fastener 96 that is disposed within the first portion of the body aperture 24 of the apparatus 10 and force the fastener 96 to be biased in the direction 60 (e.g., at least generally through the tack strip 94 and into the support structure 92 as shown in FIG. 4). The spring 48 of the apparatus 10 is utilized to bias the head 32 of the striker pin 14 in a direction substantially opposite to direction 60, so that the striker pin 14 may recoil back to a resting position (as shown in FIG. 3) to be struck again when positioned over another fastener 96.

By repeating the relevant steps of the process with other started fasteners associated with the tack strip 94, a substantially uniform spacing of the tack strip 94 from the surface 98 may be achieved. Moreover, in the case where the fasteners 96 of the tack strip 94 are off-set laterally from a center of the strip 94 (as is the case in some tack strips), an embodiment of the apparatus 10 may include a body aperture 24 that is likewise off-set relative to the track assembly 16. This embodiment would only allow the fastener 96 of the tack strip 94 to fit into the first portion 26 of the body aperture 24 and the tack strip 94 to fit into the guide channel 34 when the tack strip 94 is oriented property relative to the surface 98 (e.g., promote proper orientation of the tack strip 94 so that the brads 88 are angled toward the surface 98).

Those skilled in the art will now see that certain modifications can be made to the apparatus and related methods herein disclosed with respect to the illustrated embodiments, without departing from the spirit of the instant invention.

And while the invention has been described above with respect to the preferred embodiments, it will be understood that the invention is adapted to numerous rearrangements, modifications, and alterations, and all such arrangements, modifications, and alterations are intended to be within the scope of the appended claims.

What is claimed is:

1. Carpet installation apparatus for use in installing a carpet tack strip having partially exposed nails protruding therefrom on a support surface adjacent a substantially vertical surface, comprising:

a body comprising a longitudinal reference axis, a lower end, and an upper end longitudinally(axially) spaced from the lower end, and a longitudinally (axially) oriented body aperture extending through the body, along said reference axis and between the lower and upper ends of said body, said body aperture having lower and upper portions corresponding to the lower and upper ends of the body, wherein said lower body aperture portion includes a carpet tack nail accommodating portion disposed adjacent said lower end of said body, said carpet tack nail accommodating portion adapted to closely receive the protruding nail of the carpet tack strip;

a striker pin disposed in the longitudinal body aperture, reciprocally moveable along said reference axis and relative to said body, wherein said striker pin comprises a shaft, an upper part of which is disposed within at least the upper portion of said body aperture, and a strikable impact head interconnected with said upper part of said shaft, said shaft extending through said body aperture to a lower part disposed in the lower portion of said body aperture adjacent the carpet tack nail accommodating portion; and a tack strip track assembly disposed adjacent the lower end of said body, and comprising a horizontally disposed foot plate having a base portion for engaging the support surface, the base portion having disposed therein a carpet tack strip accommodating guide channel into which said carpet tack nail accommodating portion opens, said channel being disposed generally parallel to the vertical surface adjacent which the tack strip is to be installed, the base portion including a spacer portion disposed adjacent the channel and extending laterally a predetermined distance therefrom in respect of said carpet tack nail accommodating portion, to an extent terminating in an outer planar surface generally parallel to the guide channel for engaging the vertical surface and laterally spacing the track assembly and body therefrom by means of receiving the protruding nail into the carpet tack nail accommodating portion, wherein the predetermined distance between the carpet tack nail accommodating portion and the outer planar surface of the track assembly is such as to position the carpet tack strip in the preferred nailing position with respect to the vertical surface;

whereby said track assembly is oriented with the body aperture such that the carpet tack strip is engaged by the installing apparatus by means of the protruding nail of said carpet tack being received in the carpet tack nail accommodating portion for enabling the positioning of the tack strip by moving the installation apparatus whereafter impacting the striking head, driving the striking pin reciprocates to transit the carpet tack nail accommodating portion through the guide channel, striking the protruding nail driving the carpet tack into the support surface.

2. The apparatus of claim 1 further comprising a shock-absorbing body extension of resilient material mounted on the upper end of said body, wherein said body extension is coaxial with the longitudinal reference axis and continuous with the body to a terminal end, the shock-absorbing body extension having a longitudinal aperture through which said striker pin extends.

3. The apparatus of claim 2 further comprising a striker retaining washer disposed in the terminal end of the body extension, coaxially of the longitudinal axis, for retaining the striker pin.

4. The apparatus of claim 3 further comprising a coiled spring disposed about the shaft of the striker pin, intermediate said washer and the striker pin head.

5. The apparatus of claim 1 further comprising a handle connected to the body intermediate the lower and upper ends thereof, extending substantially perpendicularly outwardly from the body.

6. The apparatus of claim 5 further comprising a handle extension comprised of a shock absorbing resilient maternal, disposed outwardly and substantially continuously with said handle.

7. The apparatus of claim 6 wherein said handle extension terminates in a balancing foot for user contact during operation of the apparatus.

* * * * *